US006865850B1

(12) United States Patent
Campbell

(10) Patent No.: US 6,865,850 B1
(45) Date of Patent: Mar. 15, 2005

(54) TEMPORARY PROTECTIVE SHROUDS FOR PROTECTING WINDOWS AND FIXTURES DURING CONSTRUCTION

(76) Inventor: Phillip R. Campbell, 8 Crystal Mountain La., Maumelle, AR (US) 72113

( * ) Notice: Subject to any disclaimer, the term of this patent is extended or adjusted under 35 U.S.C. 154(b) by 12 days.

(21) Appl. No.: 10/719,256

(22) Filed: Nov. 24, 2003

(51) Int. Cl.[7] ..... E06B 3/26

(52) U.S. Cl. ..... 52/202; 52/222; 52/63; 160/354; 160/368.1; 160/369

(58) Field of Search ..... 52/202, 222, 273, 52/63; 160/354, 368.1, 369; 428/343

(56) References Cited

U.S. PATENT DOCUMENTS 3,251,399 A * 5/1966 Grossman ..... 160/180
4,510,986 A * 4/1985 Schwankl ..... 160/354
5,271,449 A * 12/1993 Herrick ..... 160/368.1
5,368,085 A * 11/1994 Ruparelia ..... 160/327
6,141,921 A * 11/2000 Leeuwenburgh et al. ..... 52/202
6,543,864 B2 * 4/2003 Cline ..... 312/3

* cited by examiner

*Primary Examiner*—Naoko Slack
(74) *Attorney, Agent, or Firm*—Stephen D. Carver

(57) ABSTRACT

Protective shrouds for temporarily protecting window assemblies, bathroom fixtures, and diverse prefabricated modules used in construction. The shrouds are fabricated from translucent plastic sheet material of polypropylene or polyethylene. A lower open port is selectively blocked by a foldable ventilation panel held in a deployed state by magnets. Rear mounted adhesive strips affix the shroud to the window. Top and side strips are bifurcated to enable rapid adjustments in height and length. When the tear away strips are removed, the exposed adhesive surface is pressed upon the target structure. Slight dimensional adjustments are made by pinching the sheet together, forming creases aligned with strip bifurcations, to gather material and shorten the shroud length or width. During subsequent dry-walling, shroud edges are captivated by wall board segments. Afterwards, the exposed junction between covered shroud and adjacent sheet rock portions is cut, and the shroud is torn away and discarded.

7 Claims, 18 Drawing Sheets

Fig. 11
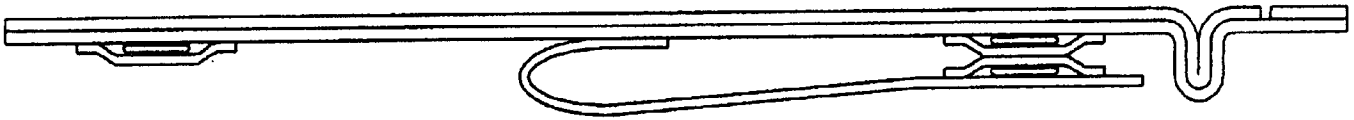
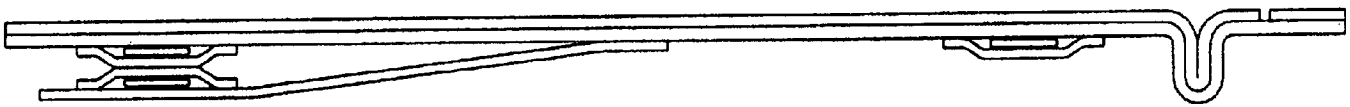
Fig. 12

TEMPORARY PROTECTIVE SHROUDS FOR PROTECTING WINDOWS AND FIXTURES DURING CONSTRUCTION

BACKGROUND OF THE INVENTION

1. Field of the Invention

The present invention relates generally to protective covers or masking shrouds that prevent paint, debris and the like from marring or defacing fixtures. More particularly, my invention relates to masking shrouds that can be actively deployed to at least temporarily protect window assemblies, bathroom fixtures, or other prefabricated modules installed during construction or remodeling.

2. Description of the Related Art

The modern building boom has been stimulated by a variety of factors, the most important one of which appears to be reduced interest rates. Residential and commercial construction rates have steadily increased over the last several years. During the last decade, sales of new residential units have approached or exceeded record levels almost every year. While the increased demand for housing has stimulated the residential construction industry, increasing jobs, profits and general activity in the area, time constraints placed upon the typical contractor have become burdensome. There is a constant rush to finish the job, as buyers are anxious to occupy new dwellings as soon as practicable. The construction boom has also created a skilled labor shortage, and in some areas, shortages of raw materials. As a result, construction costs have increased. At the same time, profit margins are constantly under threat. Successful contactors must work quickly and efficiently under constant pressure, while at the same time maintaining above-average quality control.

Partially as a result of the foregoing considerations, the use of various forms of prefabricated modules has become the norm in modern construction. For example, numerous bathroom and kitchen fixtures or modules exist. The trend is for units to be prefabricated as much as possible by the manufacturer, and to avoid the necessity of finishing or painting or coating these fixtures once installed. Modern bath and shower modules, for example, comprise upright, fiberglass units that need merely be placed upon subframes and then plumbed adequately for use. Windows of varying sizes and configurations are sold as separate, largely aluminum "fin frame" units that are quickly fitted to preconfigured, wooden sub-frames crafted by the carpenter at the job site and nailed into place. A variety of single-hung and double-hung sash windows are available in numerous sizes, styles and configurations. The use of fixtures and increased modularization in general enhance the contractors' speed and efficiency. At the same time, certain quality control problems have been aggravated.

Windows, bathroom fixtures and other modular items are installed midway through the construction process. Fin frame windows are nailed into place, and afterwards they are secured in place within the subframe by dry walling. During dry wall installation, numerous separate steps are completed. The trimming and fitting steps generate dust and debris. The finishing step involves the application of drywall "mud" to smooth border and transition areas. Wet mud can spill onto adjacent, unprotected fixtures or windows. Mudding is followed by subsequent taping and sanding, and the dust generated through the process can quickly accumulate on exposed surfaces and structures. Hand tools required for the process may be inadvertently dropped onto exposed items, and surface marring or structural damage is not uncommon. Numerous other construction processes that follow add to the mess. For example, spackled ceiling finishing can result in the widespread broadcasting of spackling compound. Unprotected fixtures and windows will require vigorous cleaning before the house can be sold.

Compounding the foregoing problems is that workers often stand or lean upon fixtures during construction. Unshielded contact with hand tools, such as those held in worker's belts; or the application of force and weight prior to the completion of installation can cause damage. Dirty footprints can accumulate and add to the mess. Anything left unprotected is further subject to attack during the painting process, occurring during one of the last stages of construction.

Normally the tedious clean-up procedures executed during the end stages of interior construction mitigates the prior accumulation of dust, debris and grime. However, it can be very difficult to remove paint stains from some devices, and it is virtually impossible to remove substantial surface blemishes caused by abrasion or impact with falling tools or equipment. Sometimes expensive shower or bathroom modules are inadvertently damaged by inappropriate worker short-cuts, exemplified for example, by the common practice of temporality placing hand tools and/or paint cans within shower stalls or upon window ledges. Sometimes even rigorous cleaning efforts cannot adequately cure surface blemishes or damage, and fixture replacement is necessitated.

The prior art has recognized the general problem outlined above. Diverse paint and masking devices that temporality cover various interior surfaces are known. Protective drop cloths are commonly deployed to prevent damage to objects in work areas. Large drop cloths deployed from rolls may be used on walkways, patios, decks, and carpeted areas. Standard drop cloths afford reasonable protection but they have certain disadvantages. For example, cotton drop cloths are not impermeable to certain fluids, so oil-based paint can pass through and deface the covered surface.

Window fixtures can be masked by paper or plastic sheeting secured to the frame periphery by adhesive tape. However, such conventional masking methods are inefficient. Substantial labor must be invested during both installation and subsequent removal. In the past, individual sashes have been covered by temporary plastic panels, which must be installed and then removed in separate time-consuming steps.

U.S. Pat. No. 2,922,392 shows an early, well-known window masking method.

U.S. Pat. No. 5,230,738 issued Jul. 27, 1993 discloses a pliable masking device for covering a targeted area during construction activities.

U.S. Pat. No. 5,441,769 issued Aug. 15, 1995 discloses a paint mask for shielding windows while painting the mullions disposed between adjacent panes. Each mask is made of flexible, plastic sheet, and is sized to cover an individual pane of glass.

U.S. Pat. No. 5,058,340 issued Oct. 22, 1991 discloses a plastic film sheet and mounting method for shrouding large planar areas like ceilings. A plastic edge connector ultrasonically welded about the periphery of the region being protected grasps edges of the shroud. Heat is applied to tightly stretch the shroud into the desired position.

U.S. Pat. No. 5,266,390 issued Nov. 30, 1993 discloses a plastic dropcloth comprising a layer of polypropylene film bonded to an intermediate layer comprising either polyethylene or polypropylene film. The polypropylene film absorbs and resists hydrocarbon liquids such as paint, wood stains, paint thinners, solvents and the like. In manufacture, the layers are fusion bonded together via heating units and pressure rollers.

U.S. Pat. No. 5,658,632 issued Aug. 19, 1997 discloses a masking strip equipped with adhesive for affixation to various structures. The mask is first placed over an area to be protected, and a desired portion of the adhesive strip is peeled back to enable custom affixation.

U.S. Pat. No. 4,263,355 issued Apr. 21, 1981 sets forth a paint shield for masking a carpet or floor edges. The paint shield is formed from sections of a flat strip of resilient material packaged in a roll. The strip is rolled flat and springs back to shape when unwound from the roll.

U.S. Pat. No. 6,143,392 issued Nov. 7, 2000 discloses a drop cloth especially configured for railings and banisters. An elongated, protective cover is fabricated from a strip of plastic or treated canvas.

U.S. Pat. No. 6,165,269 issued Dec. 26, 2000 presents a kit for masking door and room hardware during painting. A variety of masks are configured for specific pieces of hardware, such as door hinges, door knobs, dead bolts, wall outlets and electric switches. A tapered cross section portion of each mask creates a fine edge which closely fits into the joint between the hardware and the door or wall.

U.S. Pat. No. 5,468,538 issued Nov. 21, 1995 discloses a paint masking kit for windows and a method for masking windows. The masking kit comprises a plurality of reusable window balance covers for covering a header and balance portions of a window and a predetermined amount of plastic sheet material for covering each sash. Reusable plastic sheet material is applied over glass portions of the window.

U.S. Pat. No. 5,816,305 issued Oct. 6, 1998 discloses a method for protecting an object during application of a fluid onto a surface, and a drop cloth having a first layer made of non-woven fabric material and a second layer of plastic.

U.S. Pat. No. 5,330,814 issued Jul. 19, 1994 describes a protective cover pad having a backing sheet with a layer of adhesive and a removable strip of a flexible foam material, which is peelable from the adhesive surface. The strip of foam-like material has a greater thickness than the backing sheet and a greater width than either of the side portions of the backing sheet.

U.S. Pat. No. 5,103,593 issued Apr. 14, 1992 discloses a door shield for temporarily covering a door during construction. A polymeric rear layer mounts an accordion-pleated forward surface formed of parallel ribs to provide impact resistance. Magnetic and adhesive members are coextensively formed at a rear perimeter of the door for adherence of the structure to the door.

U.S. Pat. No. 4,921,028 issued May 1, 1990 discloses a door hardware cover that can protect knobs and locks. A plastic sheet is adhesively attached to the base of the door hardware.

U.S. Pat. No. 4,398,495 issued Aug. 16, 1983 discloses a thin, sheet-like paint shield comprising intersecting longitudinal and transverse creases. The crease arrangement enables the shield to be conformed about irregular volumes such as corner moldings or the like. By flexing the shield about its longitudinal crease, the bent portion automatically snaps back into a coplanar relationship with the remaining portion of the sheet so that its maximum longitudinal length is again available for shielding while painting.

U.S. Pat. No. 5,042,656 issued Aug. 27, 1991 provides a door-shield in the form of a disposable envelope that functions as a protective sheath. The door to be protected is sandwiched between sheath sides. The envelopes are formed as large plastic and paper sheaths are pulled onto the edge of a door opposite the door edge hinged to the frame.

U.S. Pat. No. 5,921,282 issued Jul. 13, 1999 discloses a disposable protective cover for exposed plumbing fixtures.

In view of the foregoing, it is apparent that a low-maintenance, temporary protective shroud for the various fixtures or modules discussed, that may be easily deployed and then removed by the contractor when interior construction is completed, would be desirable. An adequate shroud must be light-weight, protective, durable, tear-resistant, and liquid-proof. It must not interfere with the ability of the contractor or subcontractors to efficiently carry out their missions. Preferably, a single size must fit a variety of applications, and quick adjustments to shroud size must be possible at the job site without time-consuming measuring and cutting. Once interior construction or remodeling is complete, the shroud must be removable as fast as possible.

BRIEF SUMMARY OF THE INVENTION

This invention provides a shroud system for protecting window fixture, bathroom fixtures, shower modules, and other prefabricated items during construction.

My new protective shrouds are quickly fitted to conventional window assemblies, bathroom fixtures, prefabricated modules or the like. During the many facets of construction, any object upon which one of my shrouds has been deployed is isolated and protected from dust, debris, and inadvertent injury. Not only is cleanliness maintained, but damages from contact with humans or tools or spilled liquids like paint, dry wall mud, or the like is avoided. After interior construction is substantially completed, the shroud is easily and quickly removed simply by cutting, and after tearing away and discarding the shroud body, no trace is left of the shroud.

The preferred window shroud is generally rectangular, and is made from resilient plastic sheets of polypropylene or polyethylene. Preferably the shroud is translucent, so the window framework is clearly visible after installation. The preferred arrangement has a lower open port that is selectively blocked by a foldable panel. This panel may be temporarily disposed in an open configuration, exposing the port, by a set of magnets that hold it in a deployed position. The flexible ventilation panel is also translucent.

The shroud comprises a number of back-mounted, adhesive tear-away strips that affix it to the window. When the tear away strips are removed, the exposed adhesive surface is pressed upon the window structure. However, to properly fit the window fixture to be protected, slight adjustments to shroud height and width may quickly be made, without time-consuming measuring or cutting steps. Importantly, the adhesive strip on the top rear of the shroud and at least one side strip are bifurcated. In other words, the composite strip along these regions is divided into two segments, with a seam or crease disposed therebetween. One piece of the strip comprises a corner segment, mounted at the rear of one upper corner. The adjoining strip segments start proximate the corner segment and extend substantially the entire length of the top or that side. The two "bifurcated" adhesive strip segments enable the gathering of sheet material by manually pinching the sheet together, to shrink it in width or length to fit the desired target window. Once installed, dry-walling may commence, and edge pieces of the shroud are thereby captivated and sandwiched permanently against portions of the window frame by various dry wall segments. After dry-walling, the exposed junction between covered shroud and adjacent sheet rock portions may be cut. This junction is smoothed over and treated with dry-wall mud for cosmetic effects. The shroud may then be torn away, removed, and discarded. A clean, undamaged and unmarred window fixture remains.

Thus a basic object of my invention is to provide a low cost shroud for shielding, windows, fixtures, modules and the like from dust, debris and overspray during construction.

A related object is to isolate windows, modules, fixtures and the like from damages that might result from contact with workers, or miscellaneous construction tools used during construction.

It is also an object of the present invention to provide a new and useful method for protecting windows, various surfaces and fixtures from fluids including paint and other compounds or mixtures comprising hydrocarbon solvents.

Moreover, it is an important object of my invention to protect otherwise-exposed surfaces of windows from debris and damages that might occur during construction activities.

It is still another object of the present invention to provide a protective shroud for windows and bathroom fixtures that may be easily adjusted during installation to snugly fit a variety of sizes, shapes and configurations.

A related object of this invention to provide a protective shroud of the character described that may be quickly and easily removed once construction is substantially finished.

Another important object of my invention is to provide a protective shroud for windows of the character described that readily facilitates the temporary opening of sash windows, so that the workers may be provided with adequate ventilation, even though the shroud is properly in place protecting the fixture.

Yet another object it to provide a highly durable shroud of the character described that is light-weight, puncture-resistant, and rapidly deployable.

A related object of my invention is to provide a shroud that is highly drapable.

Another important object is to enable the installer to adjust shroud height and width quickly without time-consuming measuring or cutting steps.

It is also an object of my invention to provide new and useful methods for protecting construction items such as fixtures, modules, windows and the like through the shroud techniques described.

These and other objects and advantages of the present invention, along with features of novelty appurtenant thereto, will appear or become apparent in the course of the following descriptive sections.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views:

FIG. 11 is an enlarged, longitudinal sectional view taken generally along line 11—11 of FIG. 9, with portions thereof broken away for clarity or omitted for brevity;

FIG. 12 is an enlarged sectional view taken generally along line 12—12 of FIG. 9, with portions thereof broken away for clarity or omitted for brevity;

DETAILED DESCRIPTION OF THE INVENTION

Figure 1:
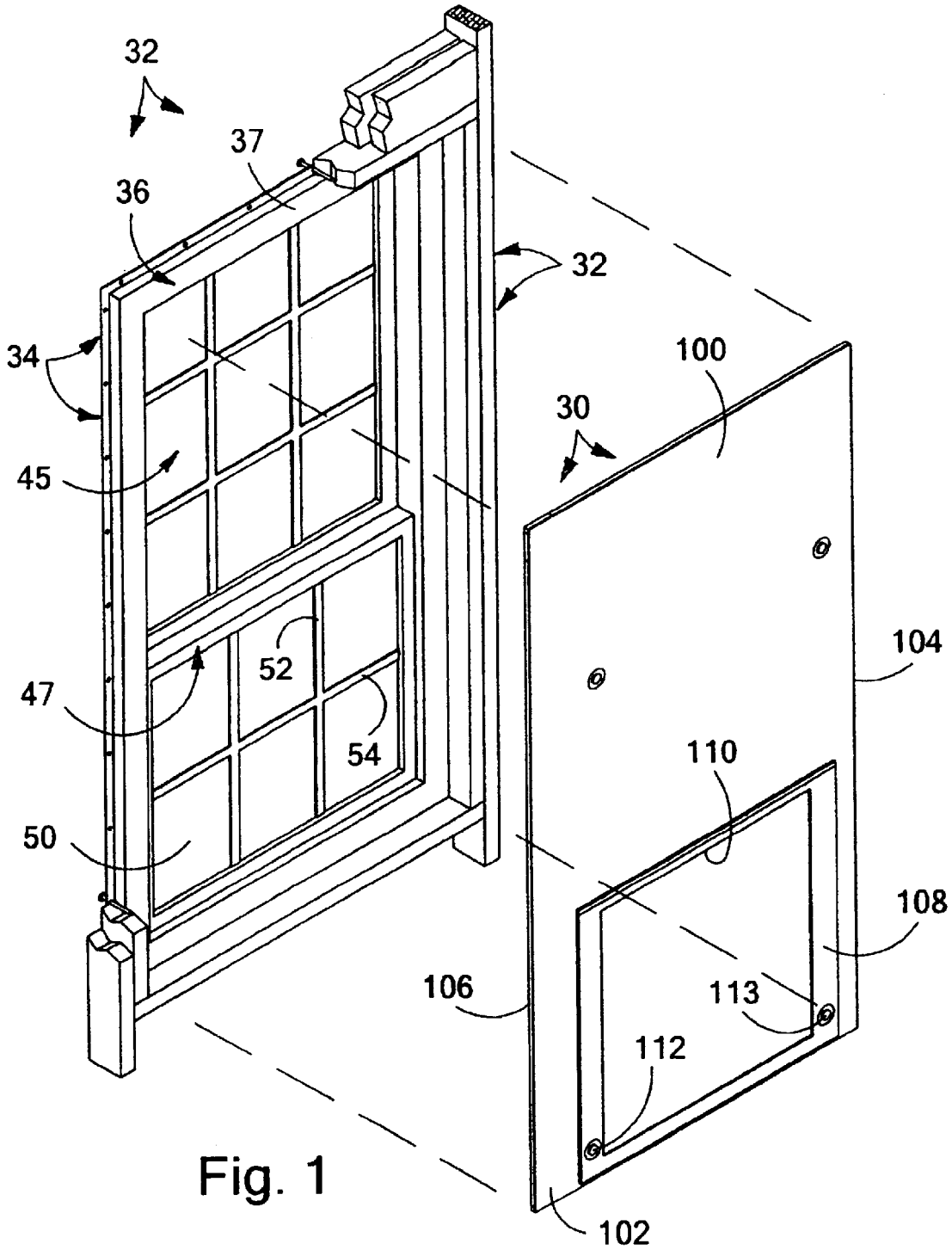
FIG. 1 is an exploded, fragmentary isometric view showing a double sash, fin-frame window partially installed within a sub-frame, with a window shroud constructed in accordance with the best mode of the invention situated proximate the window and ready for installation.

Turning initially to FIGS. 1–6 of the appended drawings, my new protective window shroud has been generally designated by the reference numeral 30. It is adapted to be fitted to a conventional window assembly 32 during construction. Once fitted properly, as hereinafter described, frame construction around the window, including dry-wall construction and the like, proceeds non-destructively, and the window is protected from unwanted contact with dirt and debris. After interior construction is substantially completed, the shroud 30 may be quickly removed, revealing a clean and undamaged window fixture.

Figure 2:
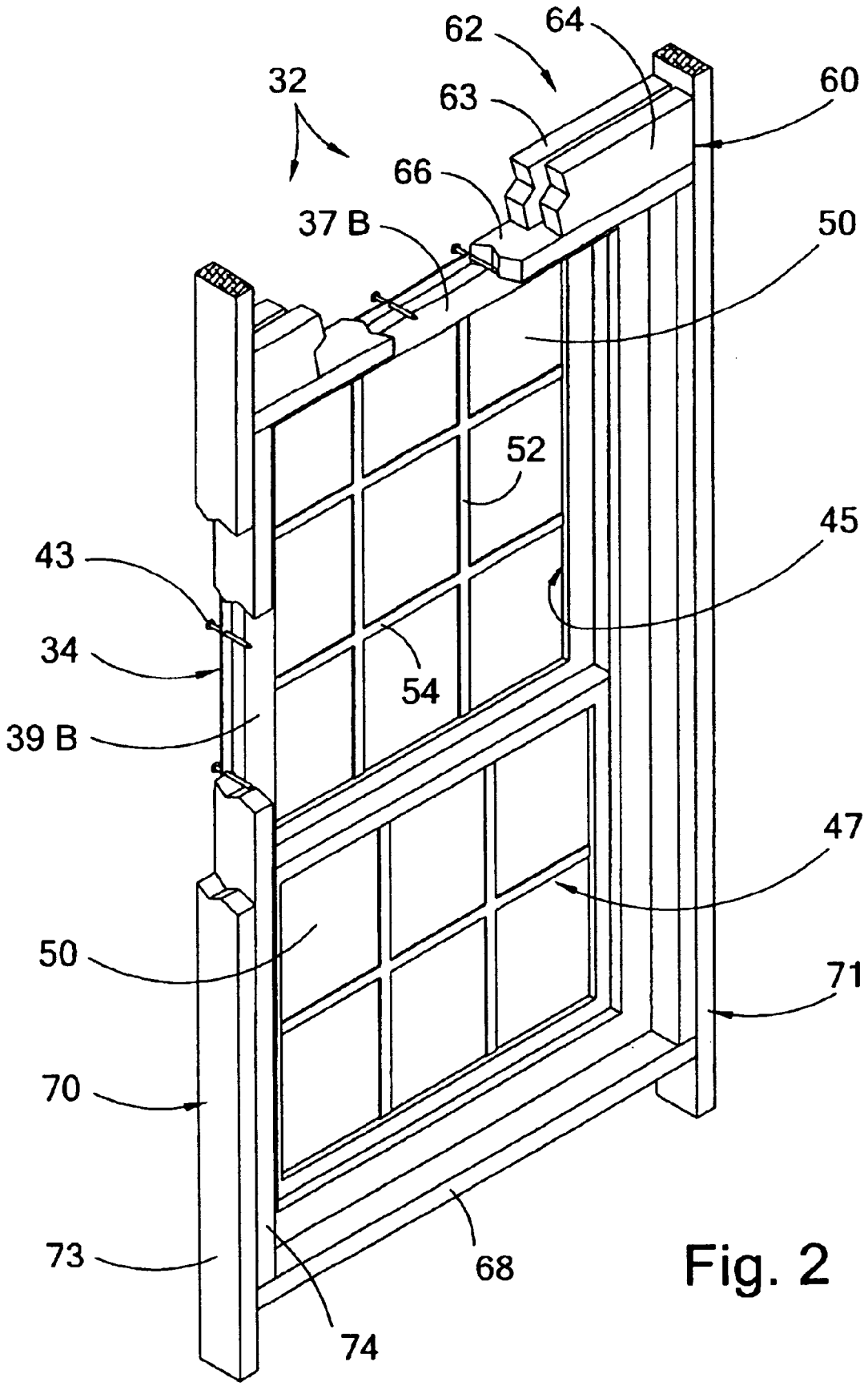
FIG. 2 is a fragmentary, isometric view showing the double sash window of FIG. 1 partially installed.
Figure 4:
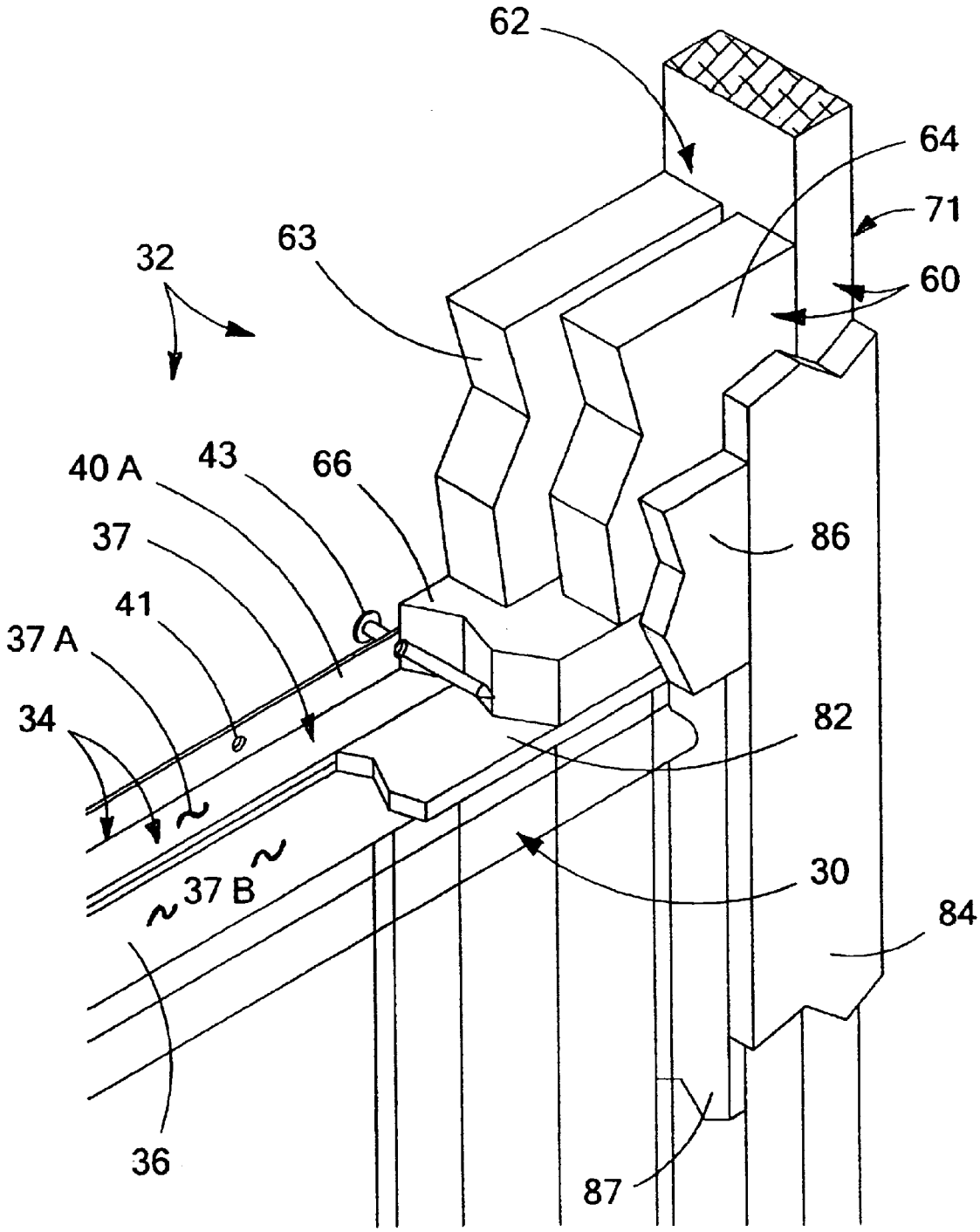
FIG. 4 is an enlarged fragmentary, isometric view of the corner region of the window and its frame, with portions thereof broken away for clarity.
Figure 6:
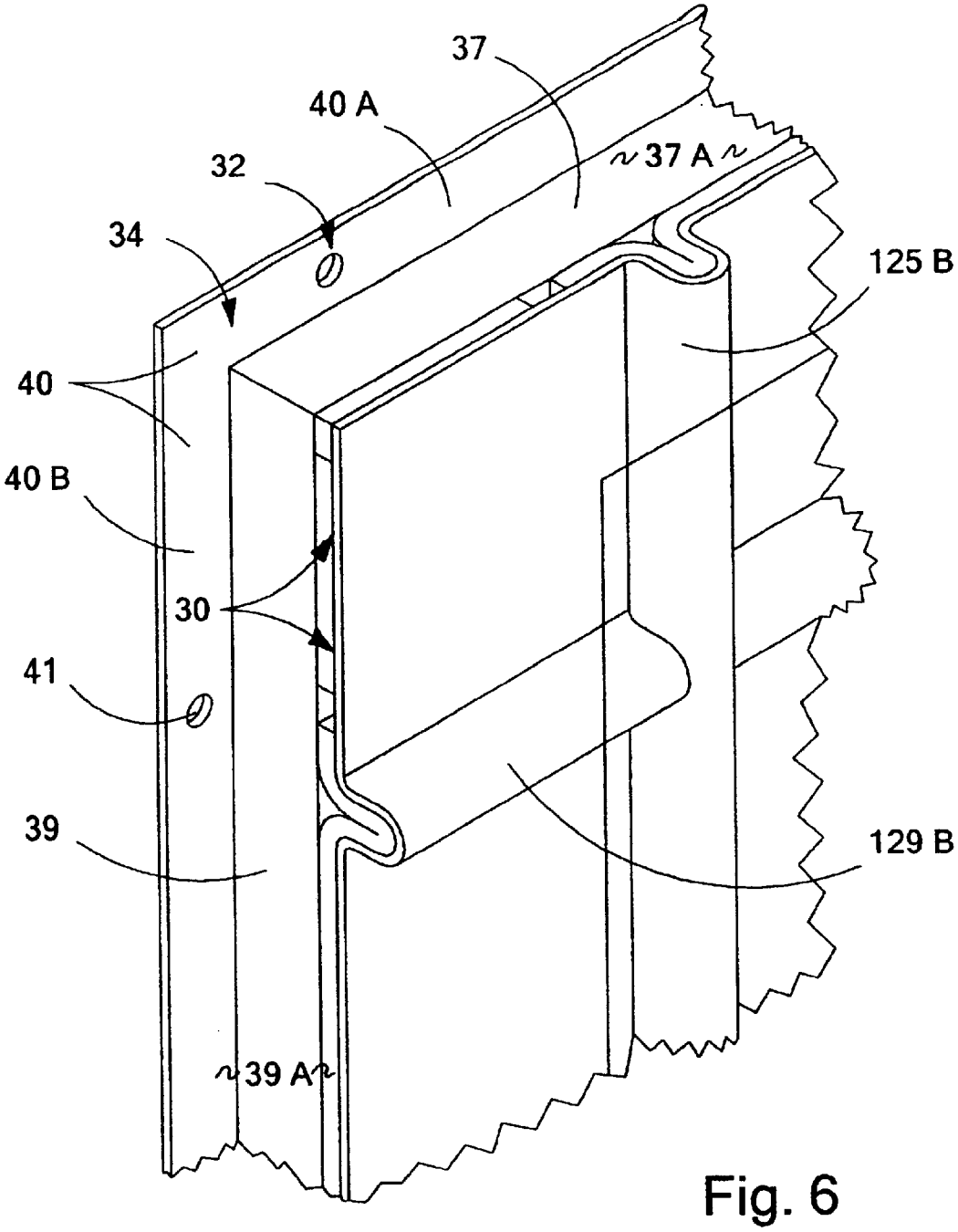
FIG. 6 is a greatly enlarged, fragmentary isometric view of the front left corner region of the window as seen in FIG. 5, showing width and height adjustments, and with certain portions greatly exaggerated in size for clarity.
Figure 7:
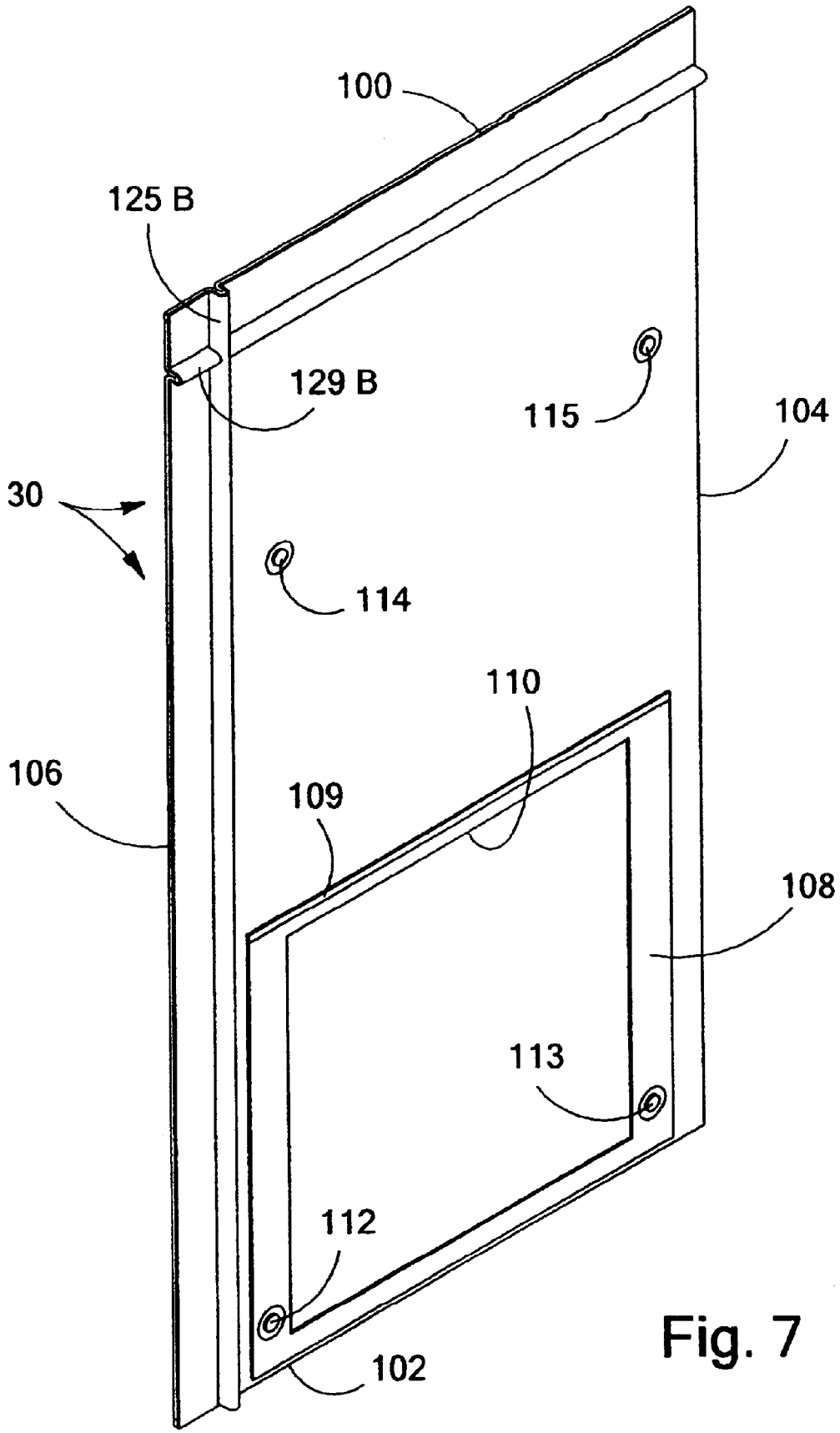
FIG. 7 is a frontal isometric view of the preferred window shroud, with the lower panel closed, as it appears with preliminary width and height adjustments.

For informational purposes, the window assembly 32 comprises a conventional dual sash, fin frame window 34. A generally rectangular window frame 36 is formed from extruded aluminum pieces in a desired configuration, with a conventional size and aspect ratio. The upper horizontal span has been designated by the reference numeral 37, and that spans' upper surface has been designated by the reference numeral 37A (FIGS. 4 and 6). The flat, inwardly facing vertical surface of the upper horizontal span has been designated by the reference numeral 37B (FIGS. 2, 4).

The leftmost vertical span has been designated by the reference numeral 39, and its outer surface has been designated by the reference numeral 39A (FIG. 6). Those familiar with the art will note that a thin, peripheral "fin" 40 is disposed at the exterior side of the window, comprising a vertical portion 40A (FIGS. 4, 6) that borders span surface 37A, and contiguous and integral vertical portions 40B that adjoin surface 39A. This step-like, notched profile enables mounting within a receptive region of a wooden subframe to be described hereinafter. Fin 40 has a plurality spaced apart orifices 41 through which conventional nails 43 (FIG. 4) may be driven to mount the assembly within the wooden subframe.

The window frame 36 houses a fixed upper sash 45, and a vertically displaceable lower sash 47. In some configurations, both the upper and lower sashes are displaceable. Each sash has a plurality of individual glass panes 50 disposed between alternate vertical mullions 52 and horizontal mullions 54 (FIGS. 1 and 2). Of course it should be recognized that single pane sashes exist as well. Moreover, single sash units are common, and the invention has equal utility when used with various window units of multiple configurations and sizes.

The fin frame window 34 is seated within an appropriate subframe 60, framed with conventional wooden pieces recognized by those skilled in the art. An upper, horizontal header 62 forms the top of the subassembly. It comprises a pair of transversely extending, spaced apart and parallel two by ten pieces 63, 64 (FIGS. 2, 4). A transverse two by four piece 66 (FIGS. 2, 4) extends across the bottom of the header 62, beneath pieces 63 and 64. When the window is nested into the subframe, the windows top surface 37A (FIG. 6) will snugly contact the underside of header piece 66. The bottom of the subframe 60 is formed by a lower two by four piece 68 (FIG. 2) which is spaced apart from and parallel with upper header pieces 63, 64 and 66.

The parallel, left and right sides 70, 71 respectively of the subframe 60 are made of twin, two by four cripples. For example, the left side 70 comprises an outer, vertical cripple 73 that extends vertically between and beyond the upper and lower header pieces 66 and 68. However the inner cripple 74 is flushly parallel with outer cripple 73. Cripple 74 extends from lower, transverse header piece 68 to the underside of upper header piece 66 (FIG. 2). The fin frame 40 (i.e., FIGS. 2, 6) will flushly abut sides 70, 71 in assembly; further, it will abut the vertical outer edge 39A (FIG. 6) of the window frame after assembly. Nails 43 (i.e., FIG. 2) will be driven through fin frame orifices 41 when the window unit is mated to the subframe 60.

As best seen in FIG. 4, after the window unit is seated within and fastened to the subframe 60, dry walling will commence. Portions of typical drywall are illustrated, for purposes to become clear later. There is a transverse piece of drywall 82 extending horizontally across the window, beneath the header 66. The inner edge of drywall header piece 82 abuts the exposed vertical surface 37B of the window previously discussed. It extends across the top of the window to complete the framing. A span of sheet rock 84 oriented in the vertical plane extends across the side. Similarly, flat trim pieces 86 and 87 complete the sheet rocking. Similarly, the remainder of the framing is bordered by the larger adjacent wall board segment 84.

The details relating to sheet rock construction techniques and dry-wall installation configurations will be appreciated by those with skill in the art; however, the point is that the shroud 30 unobtrusively fits in with the sheet rock process as hereinafter explained. As will also be appreciated, the sheet rock work and other constructions steps performed interiorly of the structure being erected generates considerable dust and waste products, and it is desirable to protect the aluminum window fixture to keep it as clean as possible. Shroud 30 has thus been configured to "interfit" within the framing and drywall structure just discussed. Stated another way, the shroud 30 mates with the window assembly 32 and, without hindering the normal construction routine, protects the window from damage and keeps it clean. Importantly the shroud 30 does not interfere with operation of the lower sash—i.e., when protected by the shroud during construction, the window may yet be opened if desired. When the necessary construction steps are substantially completed, the shroud is quickly removed as explained hereinafter.

With joint reference now directed to FIGS. 1 and 6–8, the preferred window shroud 30 is generally rectangular, and is preferably made from resilient plastic, ideally polypropylene or polyethylene sheet. In the best mode the shroud is translucent, but in some circumstances darkly colored or opaque variations may be desirable. The top 100 is parallel and spaced apart from bottom 102, with the right and left sides 104, 106 respectively extending vertically therebetween. In the preferred embodiment the shroud 30 has a deflectable, lower ventilation panel 108 attached to it along crease 109 that covers an open port 110. This rectangular port 110 provides an opening for ventilation, needed when the window being covered is opened during construction. Optional ventilation panel 108 is also made of resilient and translucent plastic sheet. A pair of spaced apart magnets 112 and 113 are attached near the bottom of panel 108. A second pair of magnets 114, and 115 are disposed near the top of shroud 30, in similar spaced apart relation. Magnets 114, 115 are mounted with their magnetic polarity reversed, so they will attract and releasably hold magnets 112, 113 when the ventilation flap is opened. When flap 108 is gently lifted up to expose the port. 110, the panel magnets 112, 113 can be pushed into temporary binding contact with magnets 114, 115 that will hold the panel open, as in FIG. 9. On the other hand, when the ventilation panel is "down" (i.e., the port 110 is blocked by panel 108), magnets 112, 113 are strongly attracted to magnets 117, 119 (FIG. 9). This third pair of magnets is spaced similarly to the others for alignment purposes, and is located near the bottom 102 of the shroud.

The shroud is preferably pressed upon and adhesively mounted to the window structure. A plurality of peel-away adhesive strips are formed at the back of the shroud along the top 100, bottom 102, and along sides 104, 106. To properly fit the window fixture to be shrouded, the installer must be able to make slight adjustments to shroud height and width, preferably without time-consuming measuring or cutting steps. Therefore an important height and width adjustment means is incorporated into the preferred design.

Figure 8:
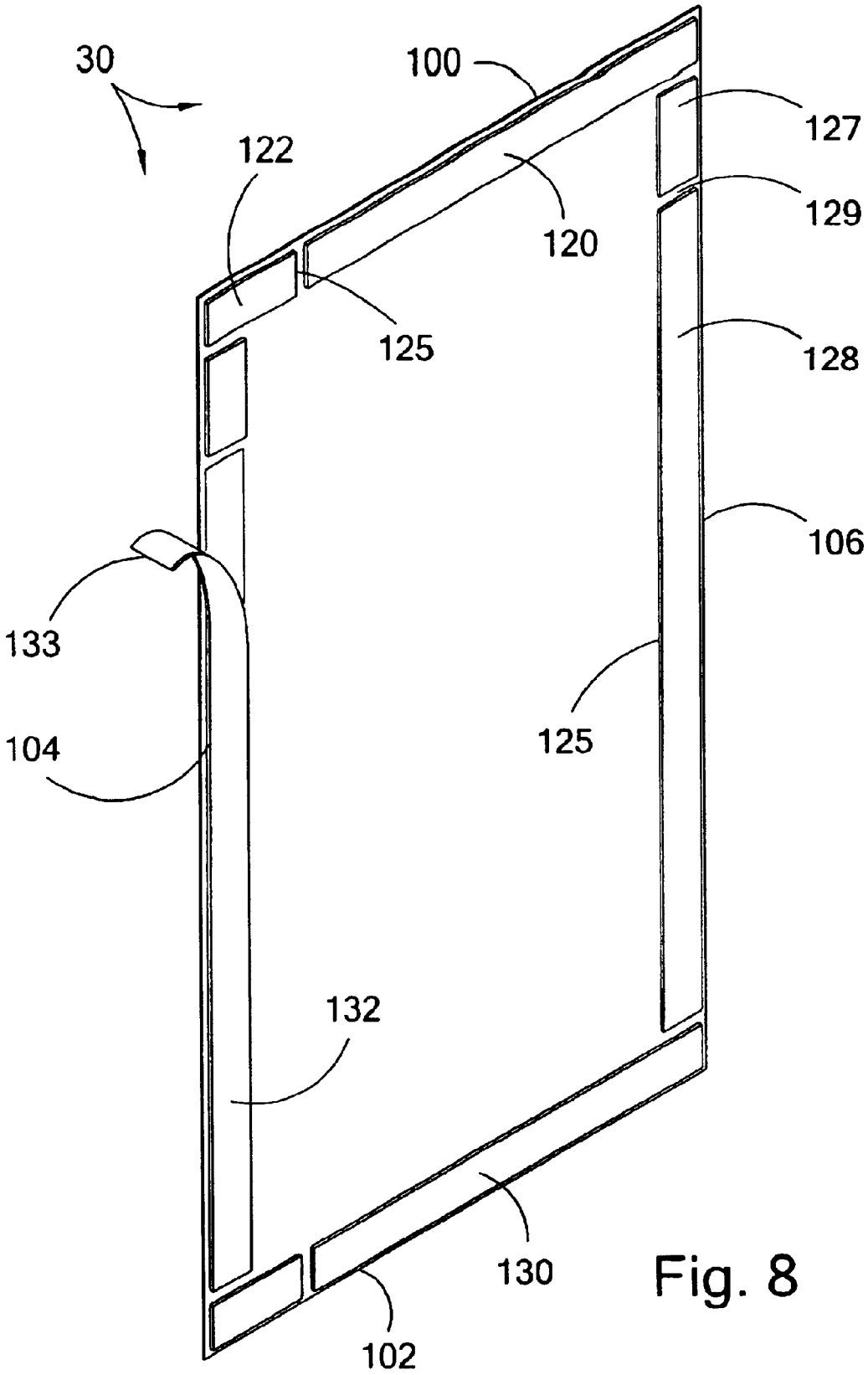
FIG. 8 is a rear view of the preferred window shroud, showing the adhesive strips and tape used for affixation and fitting adjustments.
Figure 9:
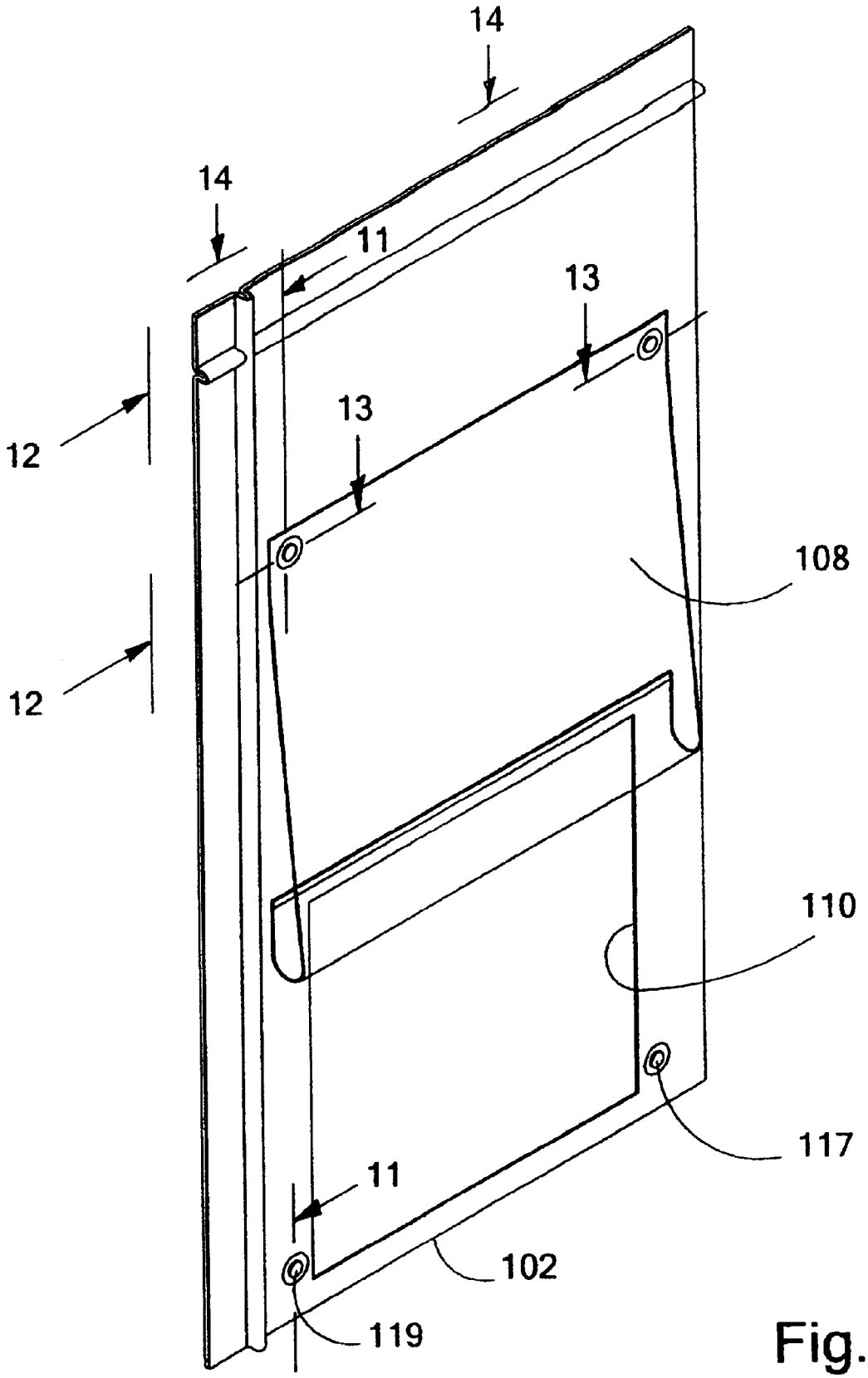
FIG. 9 is an isometric view similar to FIG. 8 showing the window shroud, with the lower panel deflected to an "open" position.
Figure 10:
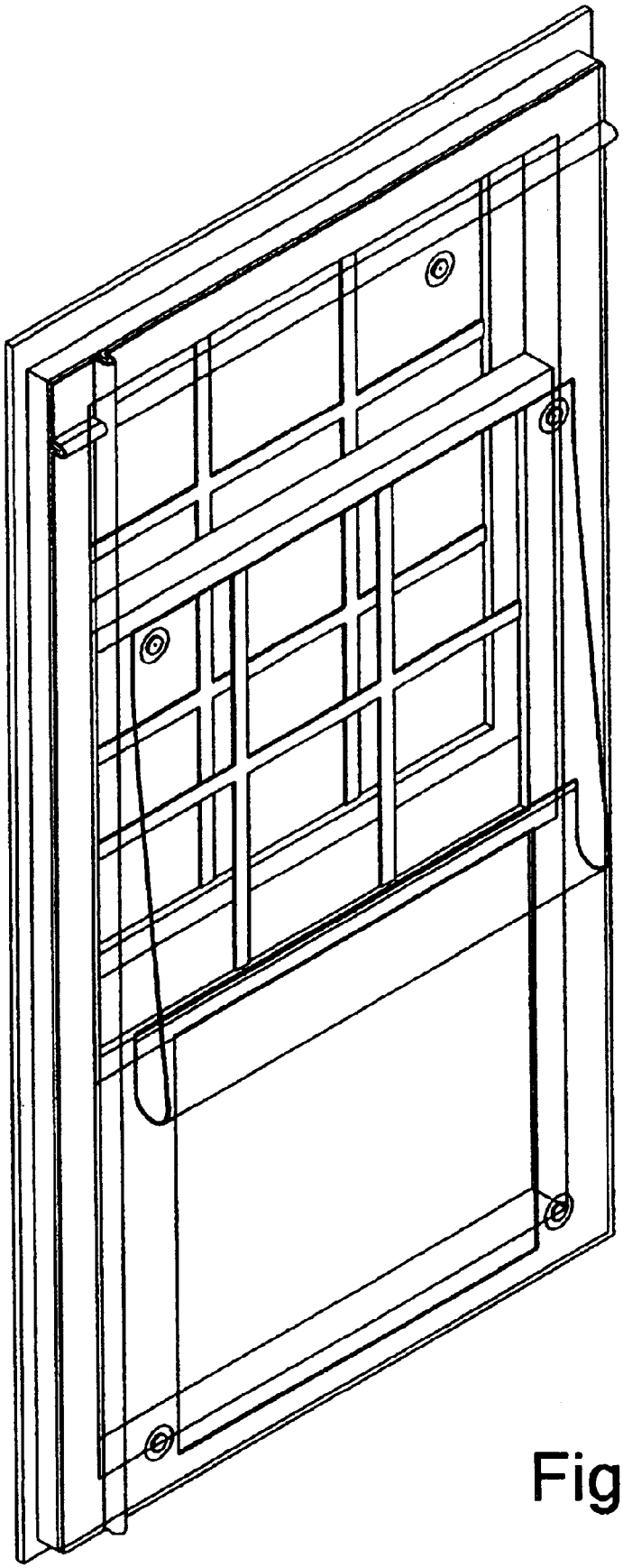
FIG. 10 is an isometric view showing the window shroud properly fitted to a window, with the lower shroud panel folded upwardly to expose the lower window sash.
Figure 14:
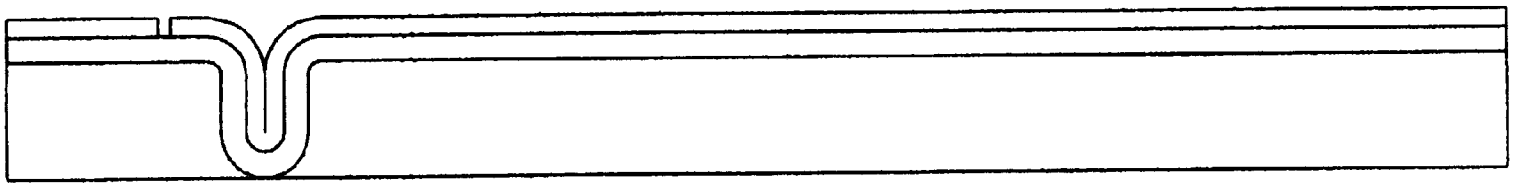
FIG. 14 is an enlarged plan view taken generally along line 14—14 of FIG. 9, with portions thereof broken away for clarity or omitted for brevity.
Figure 13:
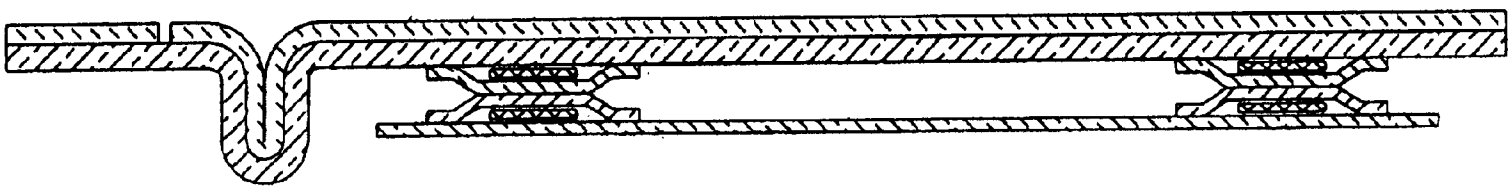
FIG. 13 is an enlarged sectional view taken generally along line 13—13 of FIG. 9, with portions thereof broken away for clarity or omitted for brevity.
Figure 15:
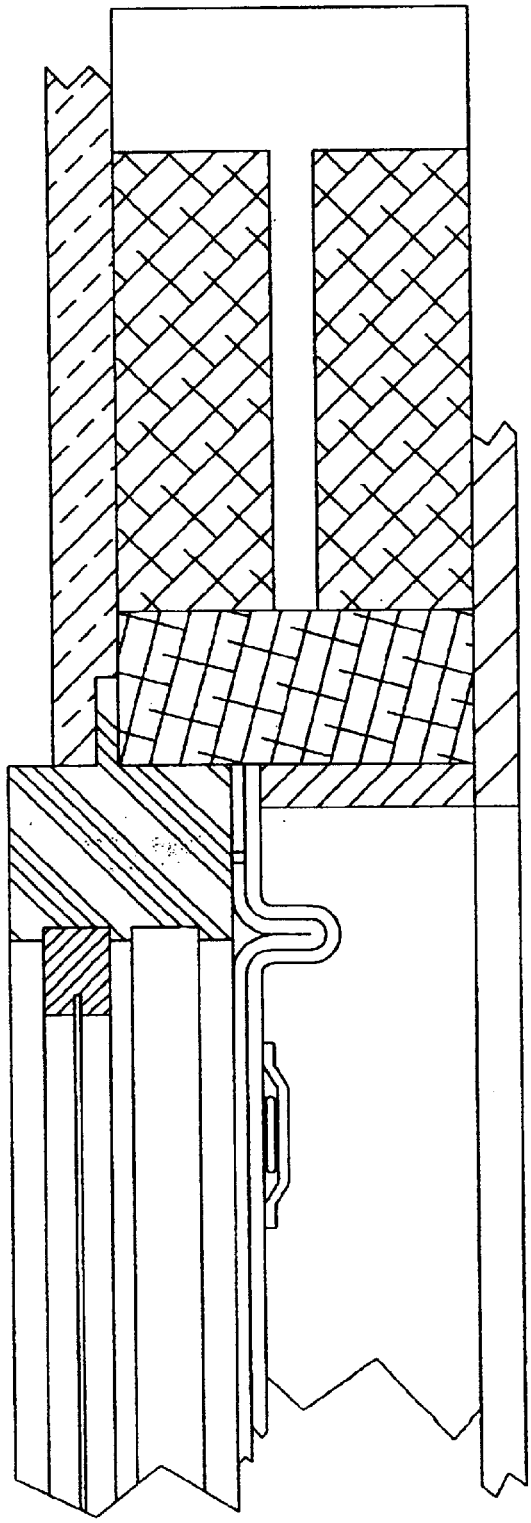
FIG. 15 is an enlarged, fragmentary sectional view taken generally along line 15—15 of FIG. 4, with portions thereof broken away for clarity or omitted for brevity.
Figure 16:
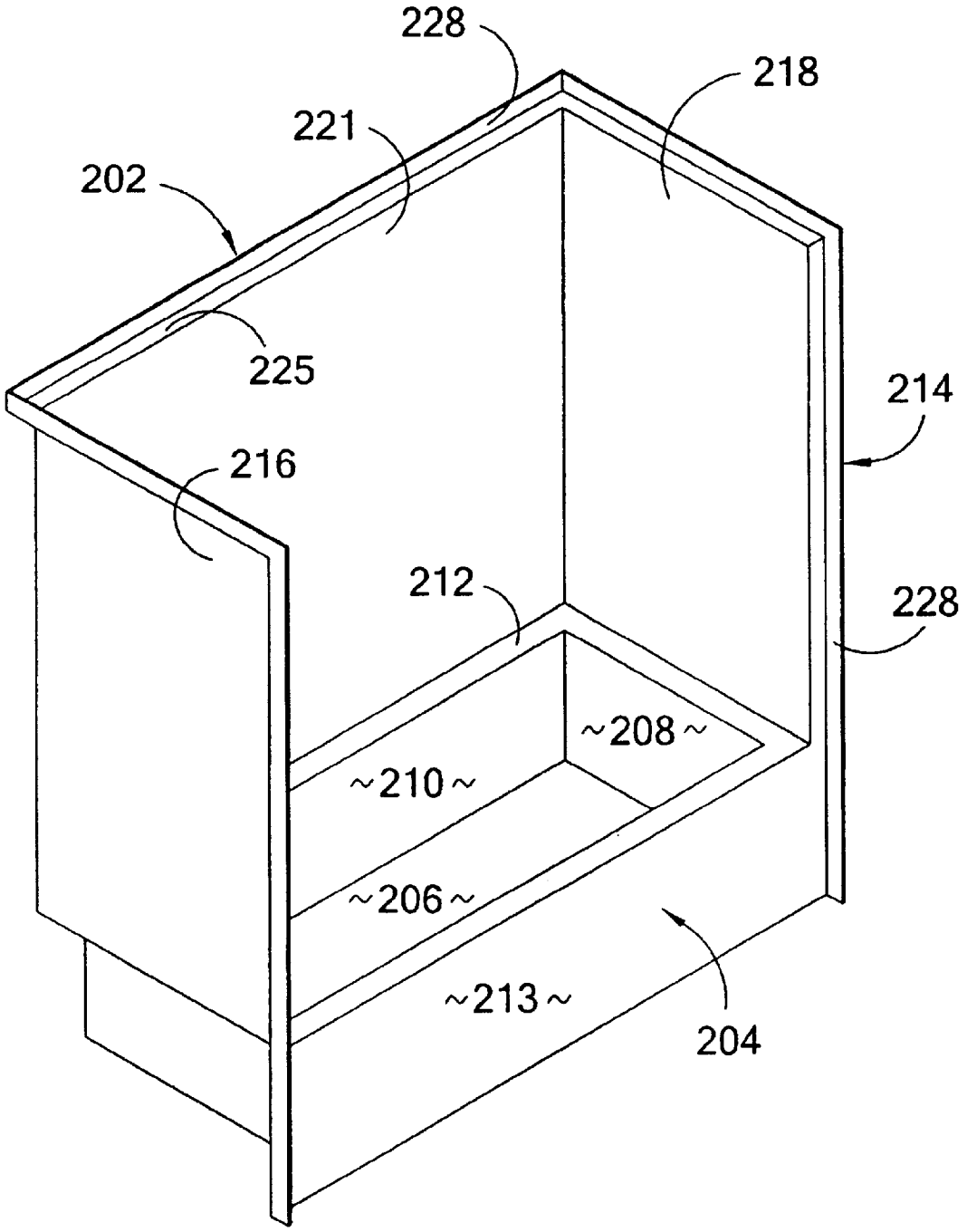
FIG. 16 is an isometric view of a fiberglass tub and shower fixture that is to be installed according to the invention.

Noting FIG. 8, there is an elongated peel-away adhesive strip portion 120 extending substantially along the length of the top 100. A similar, linearly aligned corner portion 122 (FIG. 8) substantially completes the extent across the top back of the shroud, bordering portion 120 and forming a small crease or gap 125 therebetween. The combined total strip at the shroud top 100 comprising axially aligned portions 120 and 122 is thus "bifurcated" into two segments. Similarly there is a vertically oriented peel-away adhesive strip portion 128 aligned with left side 106 (FIG. 8), which borders corner portion 127 along adjacent horizontal crease or gap 129 (FIG. 8). As before, the combined total strip at the shroud side 106 comprising portions 127 and 128 is thus "bifurcated" into two segments. The crease or gap between the axially aligned strip portions 127 and 128 makes folding or gathering easier during dimensional adjustments. However, the unitary adhesive strips 130, 132 (FIG. 8) at the bottom rear and right rear side of the shroud need not be bifurcated. Horizontal crease 129 (FIG. 8) at the shroud rear is aligned with and parallel to elongated, horizontal gathered portion 129B (FIG. 6) at the front of the shroud, that results from pinching during dimensional adjustment. Similarly, vertical crease 125 (FIG. 8), that separates strip portions 122, 120, the formation of the elongated, vertical gathered portion 125B at the front of the shroud in FIG. 8. The pinched, or gathered portions 125B and/or 129B (FIG. 6) result from width or length adjustments, and their formation is aided by the fact that the strips are bifurcated i.e., the corner portion 122 may be deployed first while dimensional approximations are made mentally during prefitting. Then, when the approximately correct size is gauged, by manually pinching together and gathering the sheet material (i.e., changing the size of gathered regions 125B, 129B) strip portions 120 and 128 may be deployed, first by removing their outer tape coverings, and then by pressing the exposed adhesive against the aligned window surface previously discussed.

In other words, when the shroud 30 is installed, the adhesive strips are used for mounting. The peel away covering 133 (FIG. 8) is removed as desired. Preferably the corner piece is activated first, and the shroud 30 is pressed up against the horizontal window span 37 (FIG. 1) against the flat, exposed, vertically span surface 37B (FIG. 4) of the window. When merely the corner of the shroud is thus attached, portions of the sheet material may be grasped and pinched together, forming the gathered ridges 125B, 129B (FIG. 6) that "take in" material to contract the width or length as desired for the job site. By suitably pinching the sheet together to form these gathered regions 125B, 129B of varying dimensions, the shroud will thus be customized into an exact "fit." Then the backing sheet on the longer adjacent adhesive strip portions 120, 128 (FIG. 8) may be removed for installing the shroud. Of course, adhesive strips 130, 133 may then be deployed in a like manner, so that the shroud 30 its up against the window.

Figure 3:
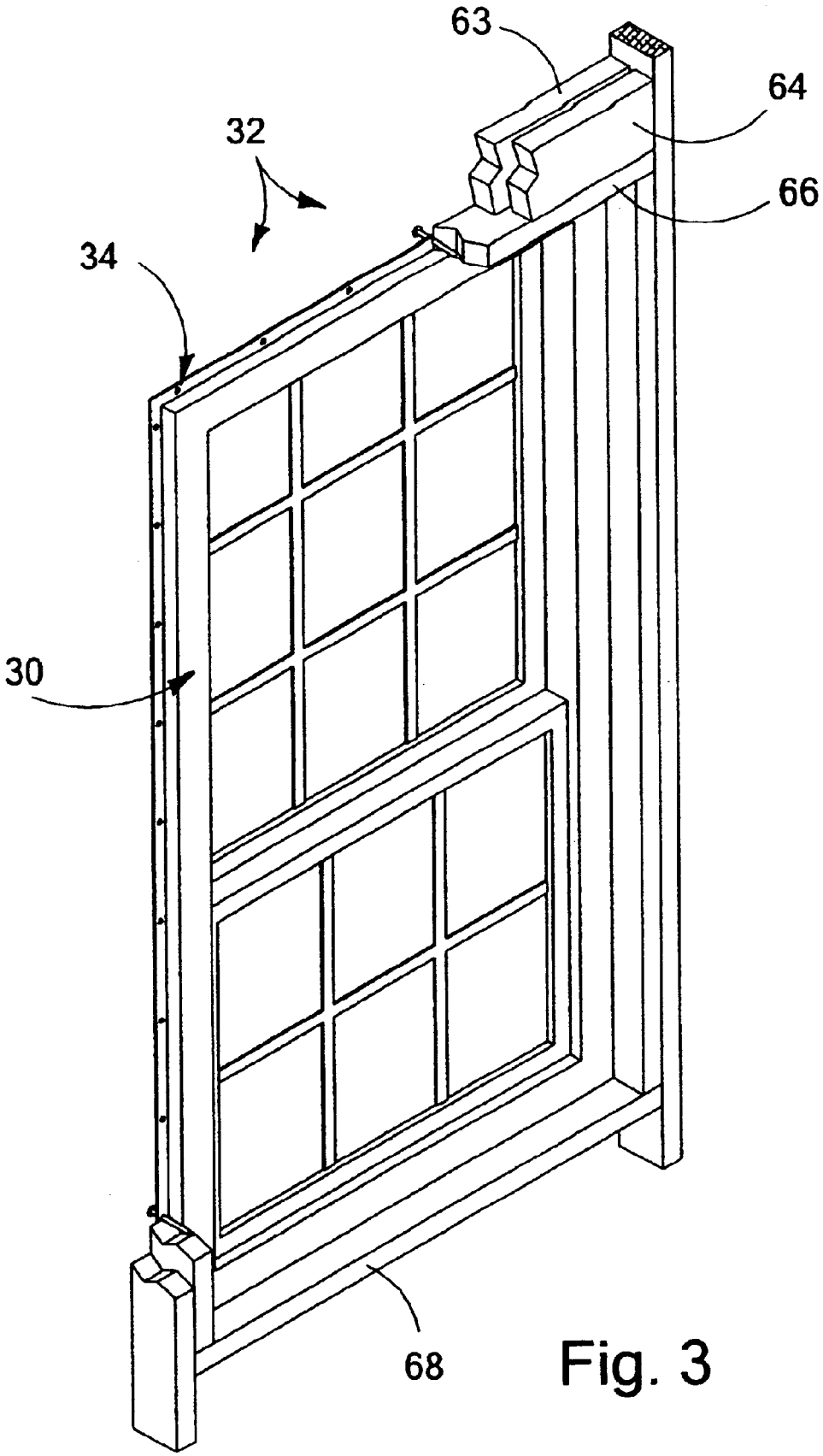
FIG. 3 is a fragmentary, isometric view showing the double sash window of FIGS. 1 and 2.
Figure 5:
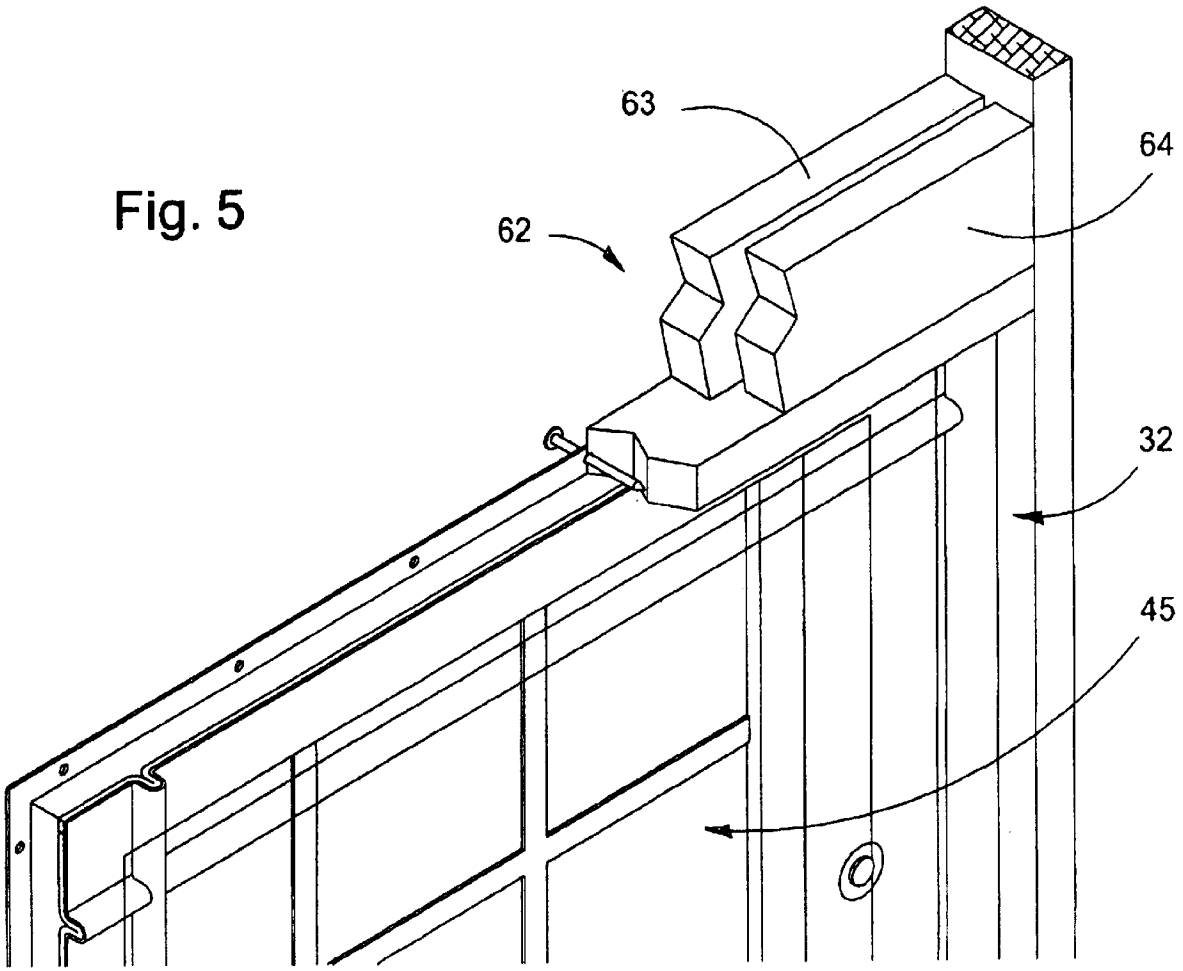
FIG. 5 is a fragmentary isometric view similar to FIG. 4, but showing the exposed top of the window and the top of the shroud.

Noting FIGS. 3–5, the shroud is installed after the window fixture (and after the window's subframe is made) but before the sheet-rock is placed. It will be noted from FIG. 4 particularly that edges of the shroud 30 are captivated or sandwiched against the window structure by various sheet-rock pieces. For example, in FIG. 4 edge portions of the shroud 30 are covered by the edges of sheet rock pieces 82 and 87. Once internal construction is completed, the seam formed between the junction regions of the shroud and drywall pieces (such as pieces 82, 84 in FIG. 4) is cut manually by a suitable bladed tool, like a box-cutter. The exposed junction that has just been cut may be smoothed over by drywall mud. Then the remainder of the shroud is torn out of the fixture and discarded, yielding a clean, undamaged window. Afterwards, even a careful inspection of the window reveals no visible evidence that the shroud was used. In other words, the peripheral shroud segments left behind after cutting do not mar the appearance of the window assembly 32.

With reference to FIGS. 16–20, an alternative embodiment of my shroud system is to be described. The protective shroud 200 (i.e., FIGS. 17–19) is adapted to be fitted to a conventional bathtub and shower fixture during its installation and subsequent construction work to prevent its surface from being marred or scratched by falling debris, paint cans, or by equipment including miscellaneous tools and supplies or the like placed upon it during construction. For example, a conventional prefabricated bath and shower assembly 202 (FIG. 16) is to be protected by the shroud 200 which is protectively placed upon it prior to framing as hereinafter described. Once properly installed, fixture 202 is protected. And, as before, upon completion of the dwelling or room construction, shroud 200 is quickly removed and disposed of, revealing a clean and unblemished bathroom fixture 202.

Figure 20:
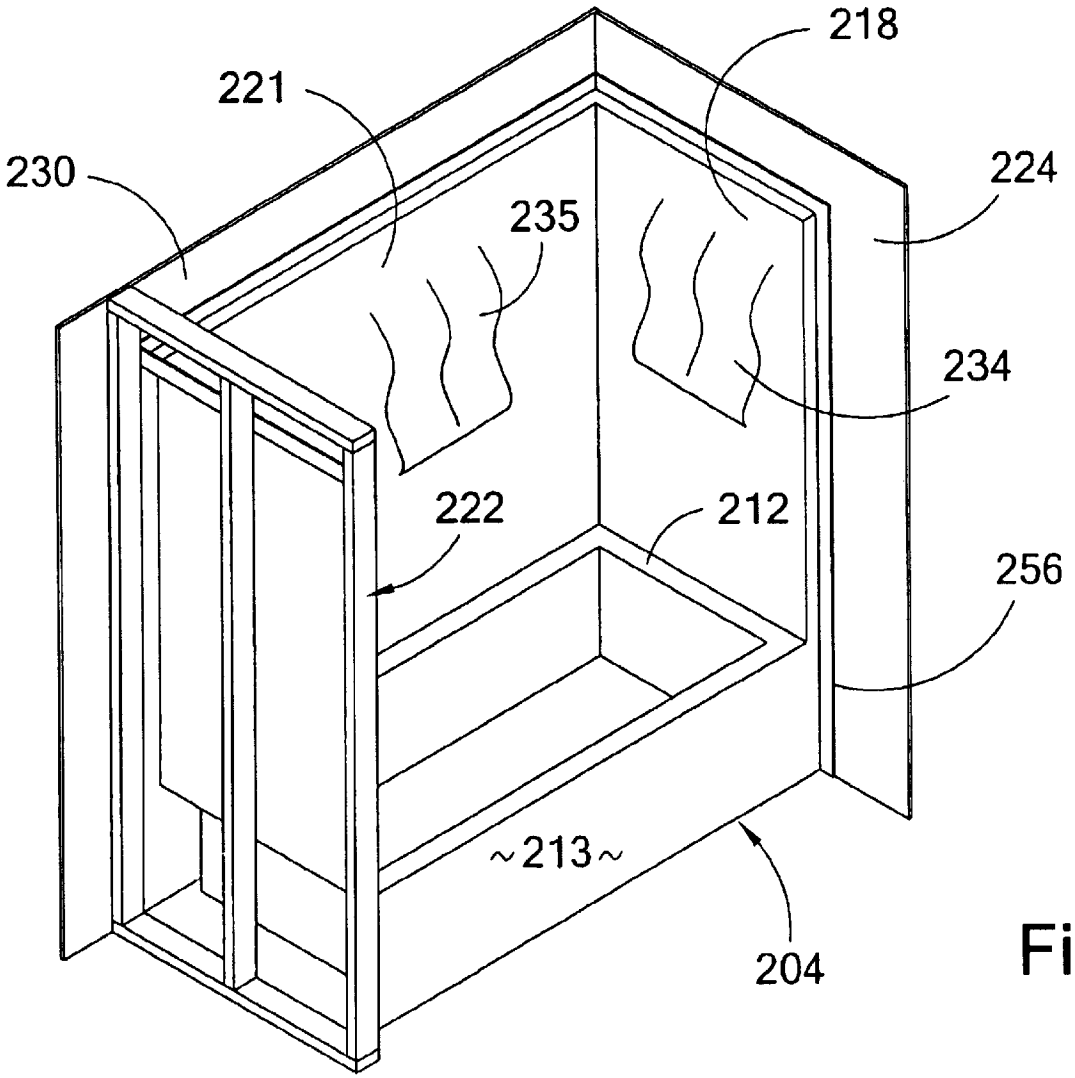

The conventional bathroom fixture 202 (FIG. 16) comprises a conventional tub 204 of generally parallelepiped dimensions. Tub 204 has a bottom floor 206 surrounded by internal ends 208, and internal walls 210, the tops of which are surmounted by a circumferential ledge 212. Outer, lower, rectangular tub surface 213 faces the viewer. The attached and adjacent shower casing 214 comprises spaced apart, upright walls 216, 218, and 221 that surround the lower tub 204. These walls rise upwardly to a circumferential upper ledge 225 that is adjacent to a surrounding, peripheral mounting flange 228. When the framing elements are thereafter deployed during fixture installation, they will abut ledge 225 and flange 228, as is well recognized in the art. Thus, as illustrated generally in FIG. 20, fixture 202 will be flushly surrounded by conventional framing 222 and drywall construction 230 (FIG. 20). Substantially contemporaneously with framing, the fixture 202 will be plumbed. All of the latter constructions operations generate appreciable dust and debris, and numerous finishing tools are used during the process. Without installing my shroud 200, the fixture can become marred or damaged.

Figure 17:
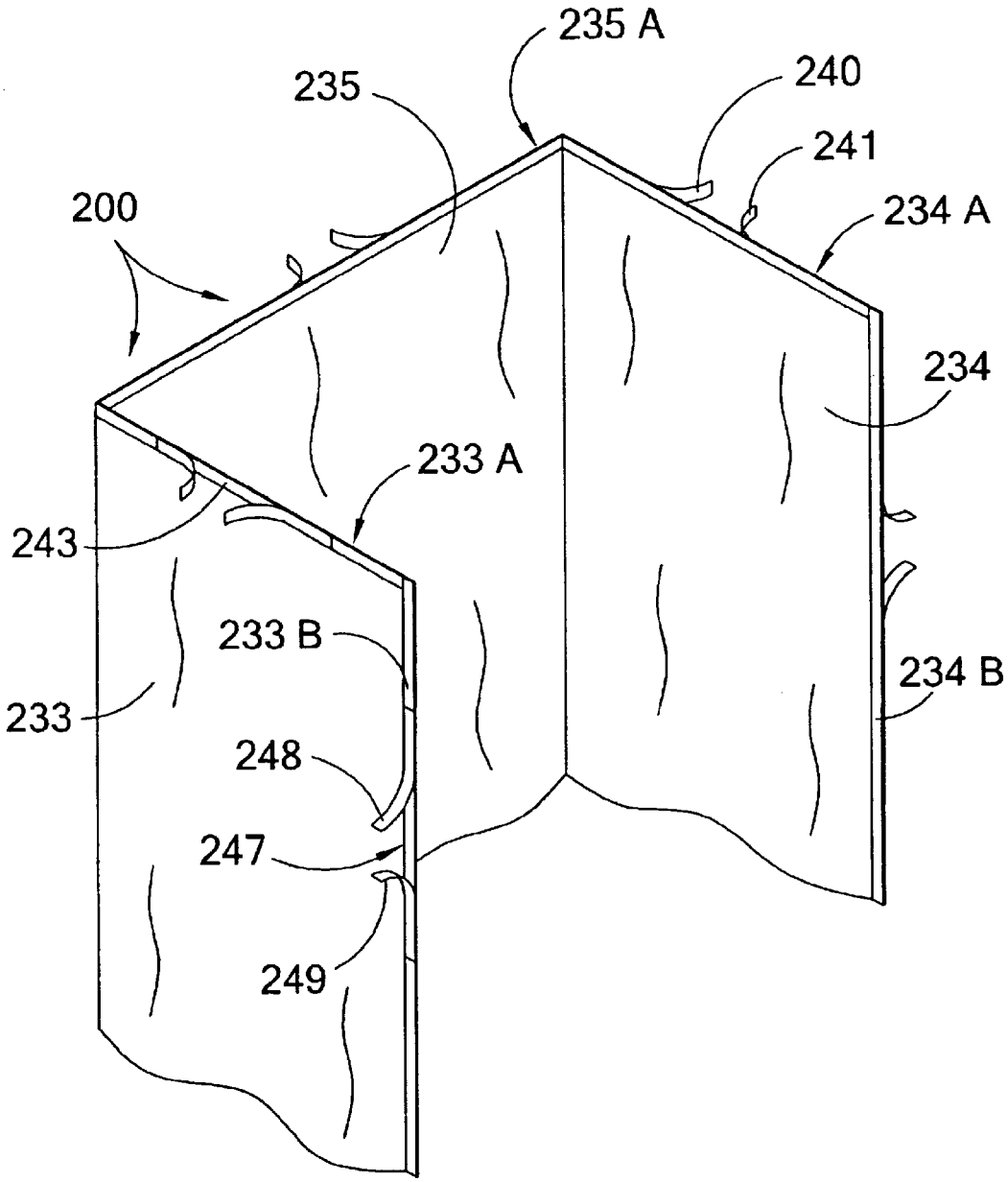
FIG. 17 is a fragmentary isometric view of a protective shroud that is to be attached to the fixture of FIG. 16.
Figure 18:
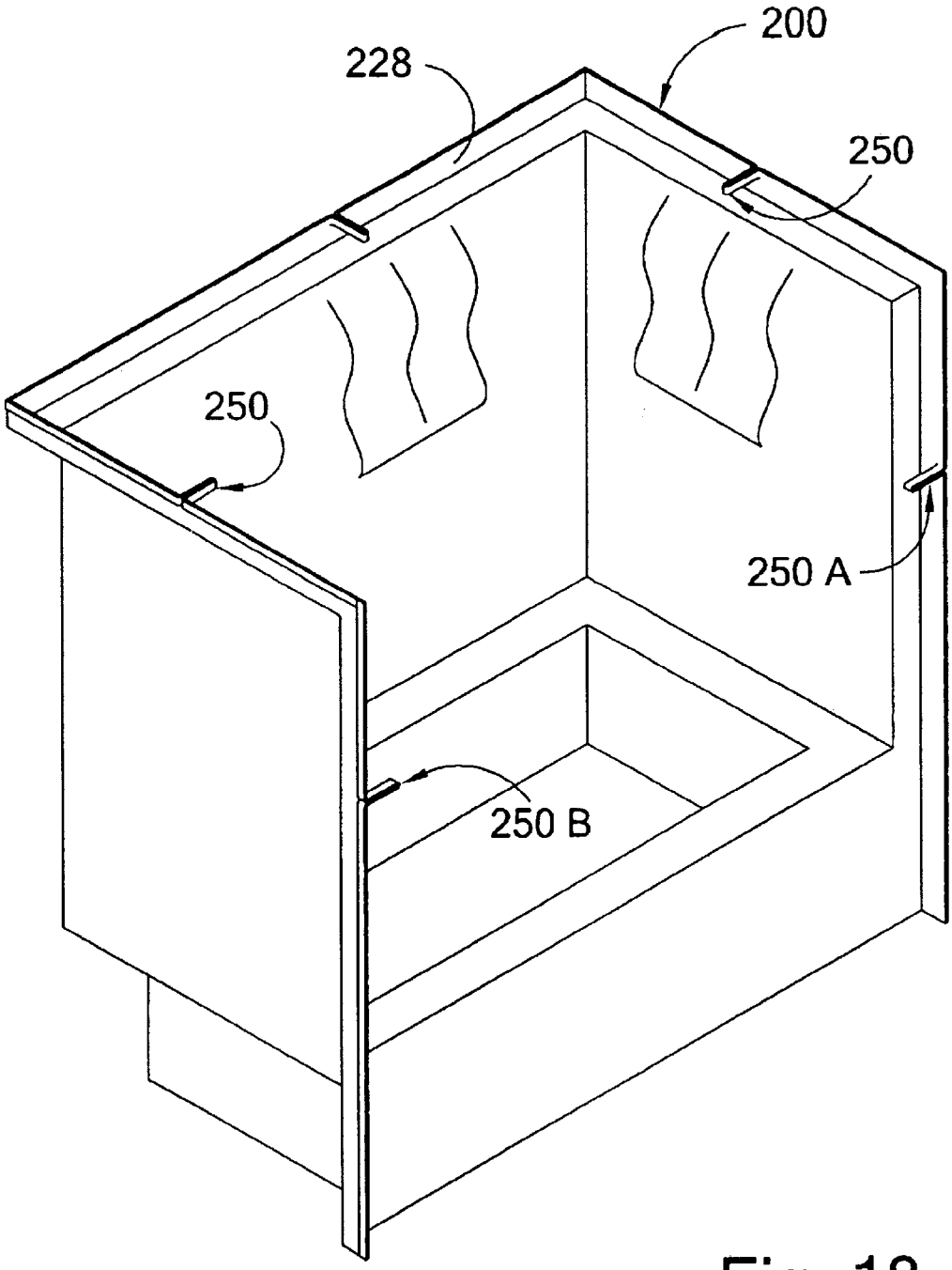
FIG. 18 is a fragmentary isometric view of a fiberglass tub and shower fixture that has my protective shroud installed.
Figure 19:
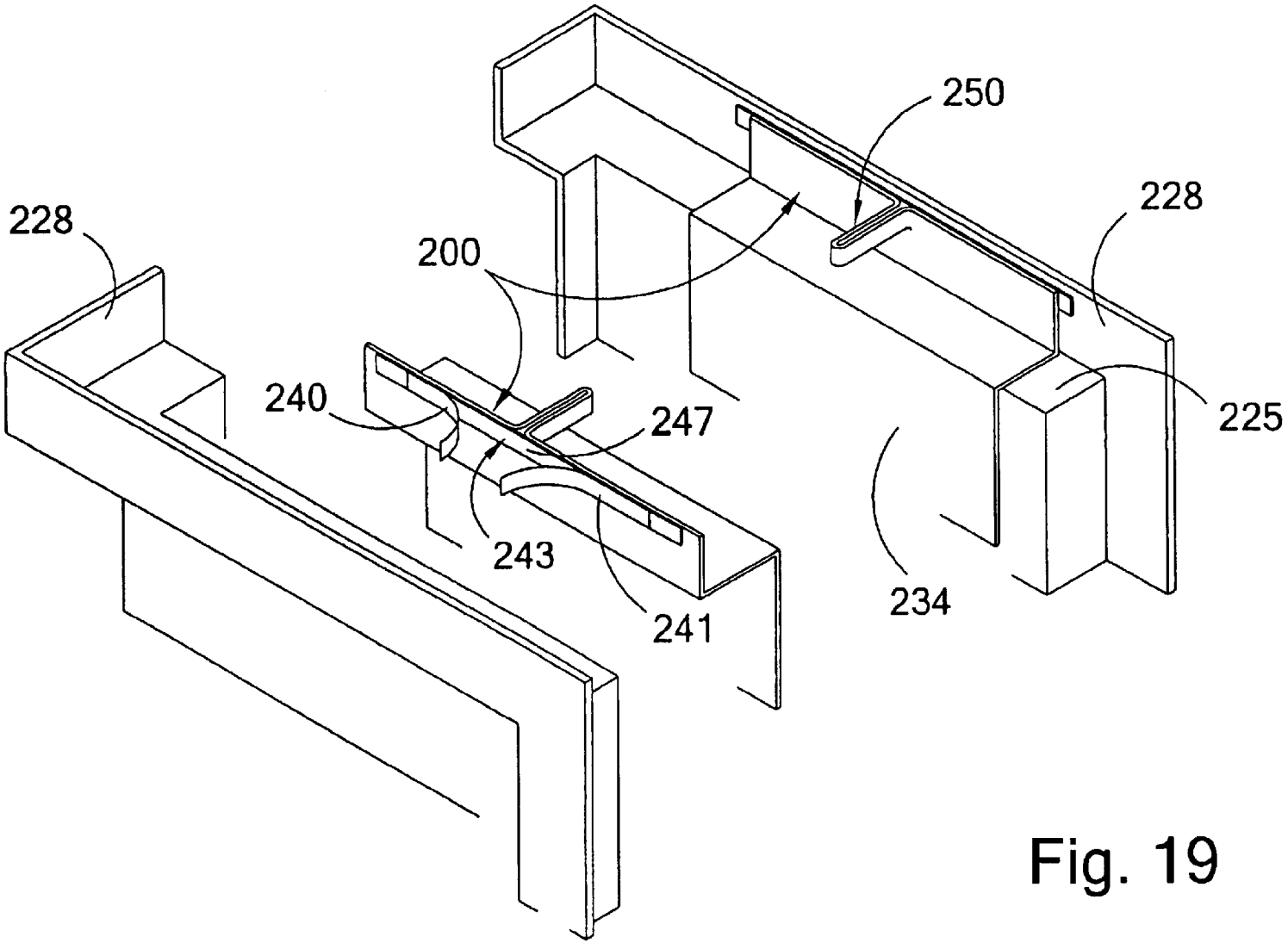
FIG. 19 is a fragmentary, enlarged and exploded isometric view showing the installed shroud; and, FIG. 20 is a fragmentary isometric view showing the shroud-equipped fixture being framed during installation.

The preferred shroud 200 is made of translucent plastic sheeting and shipped in packages of multiple disposable shrouds. A seen best in FIG. 17, a typical shroud 200 comprises adjoining, integral panels 233, 234 and 235. Panels 233 and 234 have top edges 233A and 234A respectively, with outer terminal lateral edges 233B and 234B respectively. Inner panel 235 has an upper edge 235A (i.e., FIG. 17). These edges have first runs of removable, bifurcated adhesive tape strips 240, 241 (i.e., FIG. 19) that meet in a junction comprising a separation region 243. When peeled off from the broken connecting point at the junction region 243, the strips 240, 241 are peeled back and discarded, revealing an adhesively coated region 247 (FIG. 19) of the edges that is adapted to be affixed to the exposed fixture flange region 228. Concurrently with the removal of the bifurcated adhesive strips 240, 241, an intermediate area may be gathered to produce gathered flaps 250, that enable the user to quickly approximately adjust the length and width of the deployed shroud, so as to properly cover the fixture 202 for subsequent construction work. The outer lateral edges have a second set of tape runs, having a split junction forming a separation region 247 between adjacent tape segments 248, 249. This enables quick access to the strip ends, so that the tape strips can be pealed away to expose an adhesive surface along both lateral vertical ends of the panels 233, 234 (FIG. 17). This enables gathered flaps 250A, 250B (i.e., FIG. 18) to be manipulated for adjusting the approximate vertical dimension of the shroud panels.

With construction substantially finished, immediately prior to dry wall caulking exposed edges, the shroud 200 may be cut along boundary 256 (i.e., FIG. 20) with an appropriate knife or box-cutter. Once ripped away and disposed of, the shroud yields a clean and unmarred fixture.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A shroud for temporarily protecting a prefabricated window fixture from dirt, debris and grime during a construction process, the shroud comprising:

a resilient, generally rectangular sheet of foldable, plastic material having a top, a bottom, a front, a rear, and a pair of spaced apart sides;

a first bifurcated adhesive strip extending across the back of the shroud at its top, said first strip comprising a first corner portion and a first elongated portion adjoining said first corner portion that is separated therefrom by a vertical crease at the shroud rear, with a corresponding vertical gathered region at the shroud front formed by pinching during dimensional adjustments that is aligned with said vertical crease;

a second bifurcated adhesive strip extending across the back of the shroud along at least one side thereof, said second strip comprising a second elongated portion adjoining the first corner portion that is separated therefrom by a horizontal crease at the shroud rear, with a corresponding horizontal gathered region at the shroud front formed by pinching during dimensional adjustments that is aligned with said horizontal crease; and, whereby the shroud may be press fitted to the fixture and concurrently varied dimensionally to insure a proper fit.

2. The shroud as defined in claim 1 further comprising an open ventilation port defined in the shroud and a foldable panel coupled to the shroud for selectively blocking the ventilation port.

3. The shroud as defined in claim 2 further comprising magnets attached to the shroud front and to the panel for yieldably, temporarily holding said panel in an open or closed position.

4. A shroud for temporarily protecting a prefabricated window fixture from dirt, debris and grime during a construction process, the shroud comprising:

a resilient, generally rectangular sheet of foldable, plastic material having a top, a bottom, a front, a rear, and a pair of spaced apart sides;

adhesive strip means upon the back of the shroud for attaching to said fixture;

means for adjusting the dimensions of said shroud as it is installed upon said fixture, whereby the shroud may be press fitted to the fixture and concurrently varied dimensionally to insure a proper fit;

a ventilation port defined in the shroud;

a foldable panel coupled to the shroud for selectively blocking or unblocking the ventilation port;

wherein said adhesive strip means comprises a first bifurcated adhesive strip extending across the back of the shroud at its top, said first strip comprising a first corner portion and a first elongated portion adjoining said first corner portion that is separated therefrom by a vertical crease at the shroud rear, with a corresponding vertical gathered region at the shroud front formed by pinching during dimensional adjustments that is aligned with said vertical crease.

5. The shroud as defined in claim 4 further comprising magnets attached to the shroud front and to the panel for yieldably, temporarily holding said panel in either an open or closed position.

6. The shroud as defined in claim 4 wherein said adhesive strip means further comprises a second bifurcated adhesive strip extending vertically along the back of the shroud along at least one side thereof, said second strip comprising a second elongated portion adjoining the first corner portion that is separated therefrom by a horizontal crease at the shroud rear, with a corresponding horizontal gathered region at the shroud front formed by pinching during dimensional adjustments that is aligned with said horizontal crease.

7. A shroud for temporarily protecting a prefabricated tub and shower fixture from dirt, debris and grime during a construction process, the shroud comprising:

a resilient, sheet of foldable, plastic material forming a plurality of adjacent panels, the sheet having upper edges and outer vertical lateral edges;

a first bifurcate adhesive strip extending across the upper edge of the sheet which is divided into separate strips at a first separation region;

a first adhesive region beneath said first bifurcated strip;

second bifurcated adhesive strips extending along the vertical edges of the sheet which are divided into separate strips at a second separation region;

second adhesive regions formed beneath said second bifurcated strips;

the separation regions adapted to be gathered and folded to dimensionally vary the shroud to cover the fixture;

whereby the shroud may be press fitted to the fixture and concurrently varied dimensionally to insure a proper fit.

* * * * *